US006007709A

United States Patent [19]

Duyvesteyn et al.

[11] Patent Number: 6,007,709

[45] Date of Patent: Dec. 28, 1999

[54] EXTRACTION OF BITUMEN FROM BITUMEN FROTH GENERATED FROM TAR SANDS

[75] Inventors: William P. C. Duyvesteyn; James S. Hanson; James J. Lutch, all of Reno, Nev.

[73] Assignee: BHP Minerals International Inc., Reno, Nev.

[21] Appl. No.: 09/002,057

[22] Filed: Dec. 31, 1997

[51] Int. Cl.[6] ..... C10G 1/04

[52] U.S. Cl. ..... 208/391; 208/390

[58] Field of Search ..... 208/391, 390

[56] References Cited

U.S. PATENT DOCUMENTS

| | | | |
|---|---|---|---|
| 2,871,180 | 1/1959 | Lowman, Jr. et al. | 208/11 |
| 4,120,777 | 10/1978 | Globus | 208/8 LE |
| 4,240,897 | 12/1980 | Clarke | 208/390 |
| 4,349,633 | 9/1982 | Worne et al. | 435/281 |
| 5,236,577 | 8/1993 | Tipman et al. | 208/390 |
| 5,626,743 | 5/1997 | Humphreys | 208/391 |
| 5,770,049 | 6/1998 | Humphreys | 208/391 |

*Primary Examiner*—Helane Myers
*Attorney, Agent, or Firm*—Hopgood, Calimafde, Kalil & Judlowe

[57] ABSTRACT

A process for the extraction of bitumen from bitumen froth generated from tar sands is presented. In this process bitumen froth, extracted from tar sands using a water process not requiring the use of caustic soda, is treated in a countercurrent decantation circuit with a paraffinic solvent to remove precipitated asphaltenes, water, and solids from the bitumen froth. The instant invention produces a dilute bitumen product having final water and solids content of about 0.01 to about 1.00% by weight rendering the dilute bitumen product amenable to direct hydrocracking. This process provides an alternative route to the conventional process utilizing centrifuges to separate bitumen from precipitated asphaltenes, water, and solids thereby avoiding the high capital and operating costs associated with the conventional bitumen froth treatment by centrifugation. Because the invention utilizes bitumen froth produced from a water process that does not require the use of caustic soda, it advantageously avoids the production of tailings sludges through clay dispersion. Furthermore, because the diluted bitumen product can be directly hydrocracked, the instant invention avoids the conventional and capital intensive upgrading steps, such as coking, which are required for treatment of the dilute bitumen product produced in the traditional naphtha dilution and centrifugation bitumen extraction process.

15 Claims, 1 Drawing Sheet

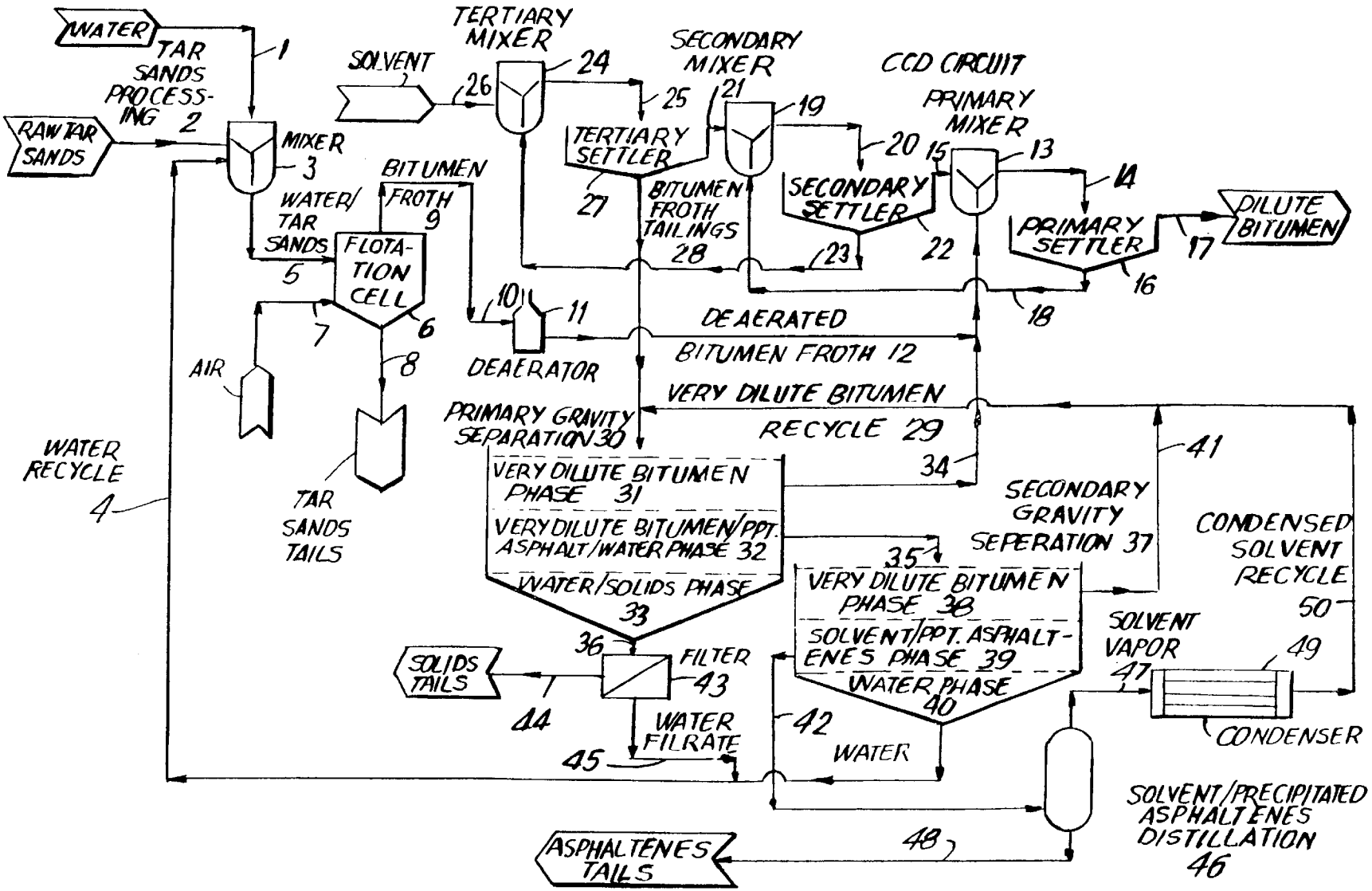
WATER
TAR SANDS PROCESSING 2
RAW TAR SANDS
MIXER 3
WATER/ TAR SANDS
FLOTATION CELL
BITUMEN FROTH
SOLVENT
TERTIARY MIXER
TERTIARY SETTLER
BITUMEN FROTH TAILINGS
SECONDARY MIXER
SECONDARY SETTLER
PRIMARY MIXER
CCD CIRCUIT
PRIMARY SETTLER
DILUTE BITUMEN
AIR
TAR SANDS TAILS
DEAERATOR
DEAERATED BITUMEN FROTH
VERY DILUTE BITUMEN RECYCLE
PRIMARY GRAVITY SEPARATION
VERY DILUTE BITUMEN PHASE
VERY DILUTE BITUMEN/PPT. ASPHALT/WATER PHASE
WATER/SOLIDS PHASE
SECONDARY GRAVITY SEPERATION
VERY DILUTE BITUMEN PHASE
SOLVENT/PPT. ASPHALTENES PHASE
WATER PHASE
CONDENSED SOLVENT RECYCLE
SOLVENT VAPOR
CONDENSER
SOLVENT/PRECIPITATED ASPHALTENES DISTILLATION
WATER
FILTER
WATER FILRATE
SOLIDS TAILS
ASPHALTENES TAILS
WATER RECYCLE

EXTRACTION OF BITUMEN FROM BITUMEN FROTH GENERATED FROM TAR SANDS

FIELD OF THE INVENTION

The present invention is directed towards a tar sands extraction process and, in particular, a counter-current decantation (CCD) process for the extraction of bitumen from bitumen froth generated from a tar sands using a water process.

BACKGROUND OF THE INVENTION

Throughout the world, considerable oil reserves are locked in the form of tar sands, also called bitumen sands. For example, the Athabasca tar sands deposit, located in northeastern Alberta, Canada, is the largest of the four major Alberta deposits and contains oil reserves exceeding 146 billion cubic meters over a total area of 32,000 square kilometers. Another such tar sands deposit exists in the Tar Sand Triangle located in a triangularly shaped area between the Dirty Devil River and the Colorado River in southeastern Utah. The Tar Sand Triangle deposit contains reserves of 12–16 billion barrels of oil in place and covers an area of approximately 518 square kilometers. However, the fact that the oil, in the form of bitumen, is intimately mixed with sand, water, sand silt, complicates its efficient extraction therefrom.

Various methods have been proposed to separate the bitumen product from the tar sands as a single component. In one method, the bitumen separated from the sands is coked to produce coker distillate which may be later refined in accordance with conventional refinery practice. In the alternative, it has been proposed that the raw tar sands be treated in a retort in either a moving or fluid bed to produce a coker distillate in which the coke which deposits on the sand is burned to provide process heat.

However, the foregoing processes have their disadvantages in that during coking, the distillate is cracked. While cracking may be desirable for obtaining economic yields, there is usually some degradation of the distillate quality.

One attempt to overcome these disadvantages is disclosed and claimed in U.S. Pat. No. 2,871,180. The method described in this patent for separating crude oil from bituminous sands in a deasphalted oil enriched layer and an asphaltene enriched layer is to provide an aqueous pulp of the sands into a vertical extraction zone. A low molecular weight paraffinic hydrocarbon (propane) is then introduced into the extraction zone at a level below the point of introduction of the aqueous bituminous sand pulp.

Essentially, the low molecular weight paraffinic hydrocarbon flows upwardly through the extraction zone while the heavier aqueous bituminous sand pulp flows downwardly. These opposing upward and downward flows result in the formation of a deasphalted oil and solvent phase (i.e., the product phase), an asphaltenes phase diluted with a lesser portion of the solvent, a water phase, and a substantially oil-free sand phase, said phases having increasing specific gravities in the order presented. The phases are then taken off for further treatment. However, this process presented several economic disadvantages that limited its use and commercial applicability.

Conventionally, the hot water extraction process, which avoids some of the disadvantages presented by the above methods, is utilized in the recovery of bitumen from the sand and other material in which it is bound. After the bitumen is recovered, it is then treated to obtain oil products therefrom. One such example of this process is disclosed by U.S. Pat. No. 5,626,743, which is incorporated herein by reference.

In the prior art water extraction process, tar sands are first conditioned in large conditioning drums or tumblers with the addition of caustic soda (NaOH) and water at a temperature of about 85° C. The tumblers provide means for steam injection and positive physical action to mix the resultant slurry vigorously, causing the bitumen to be separated and aerated to form a bitumen froth.

The slurry from the tumblers is then screened to separate out the larger debris and passed to a separating cell where settling time is provided to allow the slurry to separate. As the slurry settles, the bitumen froth rises to the surface and the sand particles and sediments fall to the bottom. A middle viscous sludge layer, termed middlings, contains dispersed clay particles and some trapped bitumen that is not able to rise due to the viscosity of the sludge. Once the slurry has settled, the froth is skimmed off for froth treatment and the sediment layer is passed to a tailings pond. The middlings is often fed to a secondary flotation stage for further bitumen froth recovery.

U.S. Pat. No. 5,626,793 discloses a modified prior art water extraction process termed the hydrotransport system. In this system, the tar sands are mixed with water and caustic soda at the mine site and the resultant slurry is transported to the extraction unit in a large pipe. During the hydrotransport, the tar sands are conditioned and the bitumen is aerated to form a froth. This system replaces the manual or mechanical transport of the tar sands to the extraction unit and eliminates the need for tumblers.

The bitumen froth from either process contains bitumen, solids, and trapped water. The solids that are present in the froth are in the form of clays, silt, and some sand and contains about 60% by weight bitumen, which is in itself composed of about 10 to 20% by weight asphaltenes, about 30% by weight water, and about 10% by weight solids. From the separating cell, the froth is passed to a defrothing or deaerating vessel where the froth is heated and broken to remove the air. Typically, naphtha is then added to solvate the bitumen thus reducing the density of the bitumen and facilitating separation of the bitumen from the water by means of a subsequent centrifugation treatment. The centrifuge treatment first involves a gross centrifuge separation followed by a series of high-speed centrifuge separations. The bitumen collected from the centrifuge treatment usually contains about 5 wt % water and solids and can be passed to the refinery for upgrading and subsequent hydrocracking. The water and solids released during the centrifuge treatment are passed to the tailings pond.

The very nature of bitumen renders it difficult to process. This is because bitumen is a complex mixture of various organic species comprising of about 44 wt % white oils, about 22 wt % resins, about 17 wt % dark oils, and about 17 wt % asphaltenes (Bowman, C. W. "Molecular and Interfacial Properties of Athabasca Tar Sands". Proceedings of the $7^{th}$ World Petroleum Congress. Vol. 3 Elsevier Publishing Co. 1967).

When bitumen is treated using the conventional naphtha dilution and centrifugation extraction process, considerable problems are encountered. The reason for this is actually two-fold: Firstly, the naphtha diluted bitumen product can contain up to 5 wt % water and solids. Secondly, the naphtha diluent solvates the bitumen as well as the unwanted and dirty asphaltenes contained in the bitumen froth. Because hydrocracking requires a homogeneous feed which is very low in solids and water, the naphtha diluted bitumen product cannot be fed directly to the hydrocracker. In order to utilize the naphtha diluted bitumen product, it must first be coked to drive off the naphtha solvent and drop out the asphaltenes and solids. Unfortunately, this coker upgrading represents an enormous capital outlay and also results in a loss of 10–15% of the bitumen initially available for hydrocracking.

One way to avoid the problems presented by the naphtha dilution of the bitumen is to use a different solvent such as a paraffinic diluent. However, the use of a paraffinic diluent results in the precipitation of a major proportion of asphaltenes from the diluted bitumen. Therefore, when the paraffinically diluted bitumen is fed to the centrifugation system, the precipitated asphaltenes may tend to "plug up" the centrifuges which results in increased maintenance due to the necessity of shutting down and cleaning the fouled centrifuges. The increased centrifuge maintenance therefore results in reduced throughput and unsatisfactory process economics. Furthermore, centrifugation equipment is highly capital and maintenance intensive even during smooth operation.

The tailings produced via the conventional extraction process present further problems. The tailings in the tailings pond are largely a sludge of caustic soda, sand, water, and some bitumen. During the initial years of residence time, some settling takes place in the upper layer of the pond, releasing some of the trapped water. The water released from the ponds can be recycled back into the water tar sands treatment process. However, the major portion of the tailings remains as sludge indefinitely. The sludge contains some bitumen and high percentages of solids, mainly in the form of suspended silt and clay.

The tailings ponds are costly to build and maintain, and the size of the ponds and their characteristic caustic condition creates serious environmental problems. In addition, environmental concerns exist over the large quantity of water which is required for the extraction and which remains locked in the tailings pond after use.

It is known that sludge is formed in the initial conditioning of the tar sands when caustic soda attacks the sand and clay particles. The caustic soda causes the clays, such as montinorillonite clays, to swell and disperse into platelets that are held in suspension and form the gel-like sludge. Since such sludge inhibits the flotation of the bitumen froth in the extraction process, lower grade tar sands containing large amounts of expanding clays cannot be treated satisfactorily using the conventional water caustic soda process.

Therefore, the need exists for an extraction process which would not require the use of caustic soda in the tar sands conditioning process, which would result in a reduction in the production of sludge and therefore an increase in the water available for recycling and a decrease in the sheer volume of tailings present in the tailings ponds. It would also be highly desirable to avoid to use of naphtha based solvents for bitumen extraction and preclude the necessity of coker upgrading of the bitumen product prior to hydrocracking. It would also be desirable to avoid the use of centrifuges with paraffinically diluted bitumen and the inherent asphaltenes plugging of such centrifuges by utilizing a non-capital intensive process which can efficiently treat a diluted bitumen containing precipitated asphaltenes while maintaining a high throughput, low maintenance, and improved process economics.

Processes to utilize alternative conditioning reagents other than caustic soda have been proposed. U.S. Pat. No. 4,120,777 and U.S. Pat. No. 5,626,743 disclose two such processes. While the former utilizes soluble metal bicarbonates in place of caustic soda, the latter teaches the use of mixtures of sodium and potassium bicarbonates in the presence of calcium and magnesium ion sources. The aim of both of these patents is to avoid the use of caustic soda in the hot water tar sands conditioning process and therefore reduce clay dispersion and subsequent sludge formation.

U.S. Pat. No. 4,349,633 avoids entirely the use of a conditioning reagent in the tar sands conditioning process and instead teaches the use of a suspension of oxidase-synthesizing hydrocarbon metabolizing microorganisms to facilitate the separation or release of bitumen from the sand, clays, and water in the tar sands.

However, such processes have not been adopted by the industry due to the fact that they substantially increase the cost of bitumen extraction from tar sands due to the higher cost of reagents employed. Furthermore, such processes often result is lower tar sands conditioning rates and thus adversely affect product throughput. Finally, although such processes may avoid the production of sludges and their inherent problems, none of the prior art addresses the problem of coker upgrading of naphtha diluted bitumen or the centrifuge plugging resulting from paraffinically diluted bitumen.

SUMMARY OF THE INVENTION

A unique, efficient, and novel process has been developed for the extraction of bitumen from bitumen froth generated from tar sands. According to the novel inventive process, bitumen froth is extracted from tar sands using a water process. The froth is then treated in a counter-current decantation circuit utilizing a paraffmic hydrocarbon as a solvent to remove precipitated asphaltenes, water, and solids from the bitumen froth.

Surprisingly, the present invention results in the production of a final dilute bitumen product having a water and solids content of about 0.01 to about 1.00% by weight which can be directly fed to a hydiocracker. This process provides an improved and alternative route to the conventional process of diluting bitumen with naphtha and, in addition, the expensive coker upgrading required to render the bitumen amenable to hydrocracking. The invention also provides an alternative bitumen extraction process that avoids centrifuge plugging encountered with paraffinically diluted bitumen products. Advantageously, the present invention does not require the use of caustic soda to condition the tar sands and thereby avoids clay dispersion and the attendant formation of sludge. Moreover, temperatures much lower that 85° C. normally used can be used to treat tar sands. Typically, the tar sands conditioning step of the present invention range in temperature between approximately 25 and 55° C. and preferably at a temperature of about 35° C. The decrease in the temperature required for tar sands conditioning results in lower energy costs and improved process economics.

According to another aspect of the present invention, a process is provided for the extraction of bitumen from bitumen froth generated from a tar sands conditioning process using water without requiring the use of caustic soda. The process comprises:

(a) treating the bitumen froth concentrate in a counter-current decantation process with a hydrocarbon solvent, e.g., a paraffmic hydrocarbon, by means of which a dilute bitumen product is produced with substantially reduced water, solids, and precipitated asphaltenes and a bitumen froth tailings or residuum, comprising either separately or intimately mixed residual bitumen, solvent, water, solids, and precipitated asphaltenes;

(b) subjecting the bitumen froth tailings comprising very dilute bitumen, solvent, water, solids, and precipitated asphaltenes, to a first gravity separation step and thus form a very dilute bitumen phase, a mixed very dilute bitumen, precipitated asphaltenes, and water phase, and a water and solids phase;

(c) recycling said very dilute bitumen phase produced in the first gravity separation step to the counter-current decantation system;

(d) subjecting the mixed very dilute bitumen, precipitated asphaltenes, and water phase produced in said first gravity separation step to a second gravity separation step to produce a very dilute bitumen phase, a solvent and precipitated asphaltenes phase, and a water phase;

(e) filtering the water and solids phase produced in said first gravity separation step and thereby produce filtered solids which are discarded as tails and a water filtrate which is recycled to the tar sands treatment process;

(f) recycling the very dilute bitumen phase produced in said second gravity separation to said first gravity separation step;

(g) subjecting said solvent and precipitated asphaltenes phase produced in the second gravity separation step to distillation to produce a vapor of the solvent which is condensed and then recycled to said first gravity separation step and thereby produce precipitated asphaltenes solid substantially free of solvent which may be discarded as tails; and (h) finally recycling the water phase produced in the second gravity separation step to the tar sands treatment process.

According to one embodiment of the present invention a process is provided for the extraction of bitumen from bitumen froth produced from a tar sands water conditioning counter-current decantation process using a paraffinic hydrocarbon as the solvent which dilutes the bitumen and substantially removes the water, solids, and precipitated asphaltenes therefrom.

According to a fiuther aspect of the present invention a process is provided for the extraction of bitumen from bitumen froth produced from a tar sands water conditioning process in which the paraffinic hydrocarbon utilized as the solvent in the counter-current decantation process has a chain length from 4 to 8 carbons.

In a still further embodiment of the present invention, a process is provided for the extraction of bitumen from bitumen froth produced from a tar sands water conditioning process in which the paraffinic hydrocarbon utilized as the solvent comprises a major proportion of said paraffinic solvent in intimate mixture with a minor proportion of aromatic solvent.

According to a still further aspect of the present invention, a process is provided for the extraction of bitumen from bitumen froth produced from a tar sands water conditioning process wherein the paraffinic hydrocarbon utilized as the solvent in the counter-current decantation process is comprised of a mixture of pentane and hexane.

According to a still ftrther aspect of the present invention, a process is provided for the extraction of bitumen from bitumen froth produced from a tar sands water conditioning process in which the paraffinic hydrocarbon utilized as the solvent comprises a mixture of about 50% by weight pentane and about 50% by weight hexane.

Because the present invention does not require the use of caustic in the initial tar sands conditioning process and utilizes a CCD circuit in place of centrifugation for bitumen recovery from the froth concentrate, it is able to efficiently extract bitumen from tar sands without producing clay dispersion sludges and without utilizing centrifuges which are prone to plugging by precipitated asphaltenes following dilution. Since the instant invention utilizes a paraffinic hydrocarbon as a solvent for the bitumen, an exceptionally clean diluted bitumen product having about 0.01 to about 1.00 wt % water and solids is obtained which may be fed directly to a hydrocracker thereby avoiding the necessity of pre-hydrocracker upgrading through the conventional coking process. Finally, because the instant invention utilizes a series of gravity separation stages followed by several material recycle routes for treating the precipitated asphaltenes waste product, a more efficient and environmentally friendly tar sands treatment process results.

The objects and advantages of the instant invention will be more fully understood from the following detailed description of the invention, taken in conjunction with the accompanying drawing and example.

BRIEF DESCRIPTION OF THE DRAWINGS

The accompanying drawing is a flow sheet of the process of the present invention.

DETAILED DESCRIPTION OF THE INVENTION

The instant invention has as its main aim the production of a paraffinically diluted bitumen product produced by means of a counter-current decantation process in which the solids and water content comprise approximately 0.01 to about 1.00 wt %. Thus, the diluted bitumen product can be fed directly to a hydrocracker without intermediate upgrading. The present invention has as its object the extraction of bitumen from bitumen froth produced in a tar sands water-conditioning process without requiring the use of caustic soda as called for in the prior art. The present invention substantially minimizes, if not avoids, the production of tailings sludge, that is to say, clay dispersions. Thirdly, by utilizing a series of gravity separation stages followed by several material recycle routes for treating the precipitated asphaltenes waste product, the instant invention significantly reduces the amount of wastes produced in conventional tar sands treatment processes. However, it should be understood that the instant invention might be practiced to extract bitumen from bitumen froth produced by any known means.

In the following description of the instant invention it should be understood that the term "paraffinic hydrocarbon" used herein refers to the light paraffinic hydrocarbon utilized in the extraction of the bitumen values from the bitumen froth.

In a preferred embodiment, the light paraffinic hydrocarbon utilized in the counter-current decantation process has a chain length from 4 to 8 carbons. In an alternate embodiment, the solvent utilized in the counter-current decantation process comprises a major proportion of a paraffinic solvent in intimate mixture with a minor proportion of an aromatic solvent. In a preferred embodiment, as stated herein, the light paraffinic hydrocarbon utilized in the counter-current decantation process comprises a mixture of pentane and hexane, most preferably a mixture of about 50% by weight pentane and about 50% by weight hexane.

Referring to the Figure, a process flow diagram of the process of the present invention is illustrated. A raw tar sands feed originating from a tar sands deposit is fed through a suitable conduit 1 to a tar sands conditioning mixer 3 where the raw tar sands are mixed with process water which is fed to the mixer 3 through a suitable conduit 2 and any water recycle 4. This mixing occurs at a temperature between about 25 and 55° C. and preferably at a temperature of about 35° C. The reduced conditioning temperature, when compared to a conventional conditioning temperature of about 85° C., results in reduced energy cost and improved process economics. Furthermore, by not requiring the use of caustic soda for tar sands conditioning in mixer 3, the production of sludges through clay dispersion is substantially reduced, if not avoided.

After an amount of time sufficient to mechanically separate, by mixing, the bitumen from the tar sands solids and water, the water/tar sands slurry 5 is transported to flotation cell 6. Air transported by suitable conduit 7 to the flotation cell 6 aerates the water/tar sands slurry producing a bitumen froth 9 and a tar sands tails which is transported to a tailings impoundment via suitable conduit 8.

Bitumen froth 9 produced from flotation cell 6 is then transported via a suitable conduit 10 to deaerator 11 where the froth is heated in order to release trapped air. Preferably, the deaerated bitumen froth contains about 60% by weight bitumen, which is in itself composed of about 10 to 20% by weight asphaenes, about 30% by weight water, and about 10% by weight solids. The deaerated bitumen froth 12 produced by deaerator 11 is then fed to primary mixer 13 where it is mixed with secondary settler overflow produced from the secondary settler 22 and fed to the primary mixer through suitable conduit 15. At this point it may be enlightening to explain the general concepts of counter-current decantation (CCD) and its relation to the present invention.

The primary method of separating pregnant liquor (i.e., the diluted bitumen) from gangue (i.e., the precipitated asphaltenes, water, and solids or in other words the residuum) in the present invention is termed counter-current decantation. The basic aim of gravitational sedimentation through CCD is the increase in gangue concentration and the subsequent decrease in gangue concentration contained in the pregnant liquor (Dahlstrohm, D. A. and Emmet, Jr., R. C. "Solid-Liquid Separations". SME Mineral Processing Handbook, Vol. 2, pp. 13–26 to 13–33. Society of Mining Engineers. 1985.). However, the concentration of underflow solids, or residuum, will generally range from 20–60 wt % and, therefore, contain large quantities of solution. Accordingly, this slurry is diluted again and resettled to recover further the dissolved values. As most hydrometallurgical circuits require dissolved value recoveries of 95–99.5% in the final pregnant liquor this operation must be repeated several times. If the diluting solvent were to be employed for each separation step (even if available) the pregnant liquor volume would become too large, with a consequent increase in recovery cost and a considerable loss in chemicals. Accordingly a counter-current method is employed where the solids move in the opposite direction from the liquid, and dilution solution is added only to the last one or two separation steps (in the instant invention, the solvent is added to the last stage only). Basically, as the liquid moves forward from the last separation stage it is increasing in dissolved value concentration, while the liquid portion of the solids decreases in dissolved values as it passes towards the final separation stage. Accordingly, separation is actually achieved by dilution and solids concentration through sedimentation at each stage.

Again by inspecting the Figure, the CCD circuit of the present invention can be compared to the explanation given above. As explained above, the finction of the CCD circuit of the instant invention is to increase the concentration of the precipitated asphaltenes, solids, and water while simultaneously washing the bitumen through dilution with a solvent from the precipitated asphaltenes, solids, and water contained in the bitumen froth. The instant invention, however, differs from the above description in that each separation stage or settler is coupled with a mixing stage. This is because in order for there to be adequate washing and separation of diluted bitumen from the highly viscous precipitated asphaltenes, the underflow, or residuum, from each settler, excluding the bitumen froth tailings from the tertiary settler 27, must be remixed in the following mixer.

Again, attention should be directed to the Figure. As explained above, the deaerated bitumen froth 12 produced by deaerator 11 is fed to primary mixer 13 where it is mixed with secondary settler overflow produced from the secondary settler 22, containing a large proportion of diluted bitumen and solvent, fed through suitable conduit 15. During mixing in primary mixer 13, the secondary settler overflow 15, containing diluted bitumen and solvent, solvates a portion of the bitumen contained in the bitumen froth and precipitates a portion of the contained asphaltenes. This mixture then flows through conduit 14 into the primary settler 16 where the gangue, containing some bitumen, precipitated asphaltenes, water, and solids, is separated from the diluted bitumen which flows through conduit 17 and is collected as a dilute bitumen product. Surprisingly, it has been found that this dilute bitumen product contains approximately 0.01 to about 1.00 wt % solids and water which renders it amenable to direct hydrocracking, thereby avoiding expensive upgrading through coking.

It is also important to point out that the dilute bitumen product contains a solvent to bitumen ratio of about 2 to 1. By utilizing a solvent to bitumen ratio of 2 to 1, a large amount of the dirty asphaltenes are precipitated out and removed from the diluted bitumen product while the lower molecular weight asphaltenes, which add to the value of the bitumen, are conserved in the dilute bitumen product and contribute to the overall oil recoveries from the tar sands.

A proposed mechanism of this bitumen dilution and asphaltenes precipitation can be understood by first considering the makeup of the heavy hydrocarbon feedstock (i.e., the bitumen). The bitumen is essentially a mixture of a solvent, composed of light hydrocarbons and aromatics, and heavy hydrocarbons, containing the asphaltenes, which are held in solution with the lighter hydrocarbons by the aromatics. Upon the addition of a light paraffinic hydrocarbon such as pentane or hexane, which has a low solvency power for the asphaltic materials, the solvency power of the light hydrocarbons contained in the bitumen is reduced. Effectively, the addition of the light paraffinic hydrocarbon diluent results in its dissolution into the bitumen. Upon continued addition of the light paraffinic hydrocarbon diluent, the asphaltic materials begin to precipitate out of solution when the peptizing action of the aromatics in the feed is lost. In essence, the light paraffinic hydrocarbon diluent acts as an anti-solvent throwing the asphaltic materials out of the bitumen. It has been found that this asphaltenes precipitation occurs at a diluent to bitumen ratio of about 0.7 to 1, when hexane is utilized as the light paraffinic hydrocarbon diluent.

As more hydrocarbon diluent is added, further precipitation of the asphaltenes will occur. However, continued increases in the amount of diluent added results in the re-dissolving of some of the earlier precipitated materials. This is because although the light paraffinic hydrocarbon diluent is an anti-solvent, it has some solvency power for the heavy hydrocarbon material, and if present in excess, will start to dissolve more of the precipitated heavy hydrocarbons until it is saturated. The point at which the light paraffinic hydrocarbon diluent switches from an anti-solvent to a solvent occurs at a diluent to bitumen ratio of about 2 to 1.

Because the instant invention utilizes this asphaltenes precipitation phenomena occurring at a low diluent ratio for effective bitumen extraction, a reduction in the amount of diluent to be pumped around the system and ultimately recovered is achieved. This is a definite advantage of the instant invention because a low inventory of diluent results in a commercial scale plant with smaller unit operations rendering the process less capital intensive. Furthermore, as mentioned above, the precipitation of the heaviest and dirtiest asphaltenes by the instant invention results in a dilute bitumen product amenable to direct hydrocracking.

Again, attention should be directed to the Figure and primary settler 16 illustrated therein. The streams exiting primary settler 16 are dilute bitumen product 17 and primary settler underflow transported via conduit 18 to the secondary mixer 19. Upon entering secondary mixer 19, the solids underflow from the primary settler 16 are mixed with the overflow from tertiary settler 27 and fed to the secondary settler 22 through conduit 20. The effective diluent to bitumen ratio achieved in secondary mixer 19 is approximately 20 to 1. The high diluent content of the tertiary settler overflow acts to dissolve a large proportion of the hydrocarbons contained in the primary settler underflow via the mechanism explained above.

The mixture produced in secondary mixer 19 is then transferred via conduit 20 to the secondary settler 22 for separation again into a diluted bitumen and diluent phase and a solids phase. The diluted bitumen and diluent phase exiting the secondary settler 22 through conduit 15 enters primary mixer 13 for mixing with the deaerated bitumen froth 12. The underflow from the secondary settler 22 is transferred through conduit 23 to the tertiary mixer 24.

Upon entering tertiary mixer 24, the solids underflow from the secondary settler 22 is mixed with fresh solvent fed to the tertiary mixer through conduit 26. The effective diluent to bitumen ratio achieved in tertiary mixer 24 is approximately 70 to 1. This extremely high diluent to bitumen ratio acts to scrub the solids underflow of secondary settler 22 by dissolving a major proportion of the contained hydrocarbons but excluding the dirtiest and heaviest precipitated asphaltenes. In this way, all of the valuable hydrocarbons contained in the bitumen are extracted leaving behind only those hydrocarbons which are extremely heavy and dirty and which, if extracted, would render the dilute bitumen product unsuitable for direct hydrocracking.

After mixing in tertiary mixer 24, the mixture is transferred via conduit 25 to the tertiary settler where the diluted bitumen and diluent phase is separated from the solids phase containing the heaviest and dirtiest asphaltenes, sand, clay, silt, water, residual bitumen, and diluent. The overflow from tertiary settler 27 flows through conduit 21 into the secondary mixer 19 where it is mixed with the underflow from the primary settler 16.

The underflow, or residuum, from the tertiary settler 27, now termed bitumen froth tailings 28, is then transferred to the primary gravity separation 30 where the bitumen froth tailings 28 separate into three separate phases; the very dilute bitumen phase 31, the very dilute bitumen/precipitated asphaltenes/water phase 32, and a water/solids phase 33. From the primary gravity separation 30, the very dilute bitumen phase 31 is transferred via conduit 34 and combined with the deaerated bitumen froth 12 entering the primary mixer 13 of the CCD circuit. The very dilute bitumen/precipitated asphaltenes/water phase 32 is transferred via conduit 35 to the secondary gravity separation unit 37 with the water/solids phase 33 exiting the primary gravity separation 30 via conduit 36 to the filter 43.

The water/solids phase 33 entering the filter 43 is filtered to produce a solids tails containing sand, clays, and silt, and a water filtrate. The solids tails exiting the filter 43 are conveyed to tailings impoundment through conduit 44. The water filtrate produced by filter 43 is transferred through conduit 45 into water recycle conduit 4, returning it to tar sands processing mixer 3.

The very dilute bitumen/precipitated asphaltenes/water phase 32 transferred to secondary gravity separation 37 is separated into three phases; a very dilute bitumen phase 38, a solvent and precipitated asphaltenes phase 39 and a water phase 40. The very dilute bitumen phase 38 exits the secondary gravity separation 37 through conduit 41 to the very dilute bitumen recycle conduit 29 and combined with the bitumen froth tailings 28 which is fed to the primary gravity separation. The solvent and precipitated asphaltenes phase 39 exits secondary gravity separation 37 through conduit 42 and is fed to solvent and precipitated asphaltenes distillation 46. The water phase 40 exits the secondary gravity separation 37 and is combined with water filtrate 45 and fed as water recycle 4 to the tar sands processing mixer 3.

The solvent and precipitated asphaltenes phase 39, upon entering solvent/precipitated asphaltenes distillation 46 is separated into an asphaltenes tails which exits solvent and precipitated asphaltenes distillation 46 through conduit 48 and is discarded. The solvent vapor 47 exiting solvent and precipitated asphaltenes distillation 46 enters condenser 49 and exits as a condensed solvent recycle 50 which is combined with the very dilute bitumen exiting the primary gravity and bitumen froth tailings 28 and fed to primary gravity separation 30.

The process of the present invention is further described in the following example, which is non-limiting with respect to the scope of the process of the present invention.

EXAMPLE 1

This example illustrates the product streams produced by the present invention. The deaerated bitumen froth utilized as feed in this example was prepared from an Athabasca tar sands sample which was treated in a water conditioning process without the use of caustic soda. In this example, the paraffinic hydrocarbon utilized as the solvent in the three-stage counter-current decantation process was comprised of a mixture of about 50% by weight pentane and about 50% by weight hexane with the extraction proceeding at a temperature of about 25° C.

After extraction, the $C_5$ asphaltenes content of the bitumen froth feed, the diluted bitumen product, and bitumen froth tailings was determined by dissolving a portion of each in an excess amount of pentane. The amount of asphaltenes precipitated from each of these components was then separated and weighed giving the relative $C_5$ asphaltenes contents of each of the streams.

The bitumen, water, and solids content of the bitumen froth feed, the diluted bitumen product, and bitumen froth tailings was determined utilizing the Dean Stark method. The mass distributions of solvent, bitumen, water, solids, and $C_5$ asphaltenes in the solvent feed, bitumen froth feed, dilute bitumen product, and bitumen froth tailings are given below in Table 1.

TABLE 1

Mass Distributions of Components.

| Stream | Solvent (g) | Bitumen (g) | Water (g) | Solids (g) | $C_5$ Asphaltenes (g) | Total (g) |
|---|---|---|---|---|---|---|
| Solvent Feed | 1148.00 | 0.00 | 0.00 | 0.00 | 0.00 | 1148.00 |
| Bitumen Froth Feed | 0.00 | 490.00 | 184.00 | 172.00 | 147.00 | 993.00 |
| Dilute Bitumen Product | 1013.77 | 457.72 | 0.05 | 0.05 | 98.00 | 1569.59 |
| Bitumen Froth Tailings | 134.23 | 32.28 | 183.95 | 171.95 | 49.00 | 571.41 |

As can be seen from Table 1, above, the majority of the bitumen contained in the bitumen froth reported to the dilute bitumen product while the water and solids contained in the feed reported to the bitumen froth tailings. The weight percentages of each of the components contained in the dilute bitumen product and bitumen froth tailings are given in Table 2, below:

TABLE 2

Weight Percentage Distribution of Components.

| Stream | Solvent (wt. %) | Bitumen (wt. %) | Water (wt. %) | Solids (wt. %) | $C_5$ Asphaltenes (wt. %) |
|---|---|---|---|---|---|
| Dilute Bitumen Product | 88.31 | 93.41 | 0.03 | 0.03 | 66.67 |
| Bitumen Froth Tailings | 11.69 | 6.59 | 99.97 | 99.97 | 33.33 |
| Total | 100.00 | 100.00 | 100.00 | 100.00 | 100.00 |

As can be seen from Table 2, above, the weight percentages of water and solids in the dilute bitumen product are exceptionally low rendering it amenable to direct hydrocracking. Furthermore, as evidenced by the bitumen content of the diluted bitumen product, it can be seen that this example of the inventive process resulted in better than 93% bitumen recovery from the bitumen froth. Therefore, it is seen by example that the inventive process results in an high-grade, ultra-clean dilute bitumen product and a bitumen froth tailings containing substantially all of the water and solids contaminants present in the bitumen froth.

The invention, as disclosed, utilizes a series of three mixer-settler units in the CCD circuit. However, it should be understood that any number of mixer-settler pairs could be utilized depending upon the ease or difficulty of the bitumen extraction from the particular deaerated bitumen froth feed. That is, deaerated bitumen froths that are more easily treated may not require three stages and may only require two. Conversely, deaerated bitumen froths representing more difficult separation could require more than three stages for effective bitumen extraction.

It should be understood that another separation method such as flotation may be utilized in place of the disclosed first and second gravity separation steps for treatment of the bitumen froth tailings produced from the CCD circuit. That is, although the present invention has been described in conjunction with preferred embodiments, it is to be understood that modifications and variations may be resorted to without departing from the spirit and scope of the invention as those skilled in the art will readily understand. Such modifications and variations are considered to be within the purview and scope of the invention and the appended claims.

What is claimed is:

1. A process for the extraction and recovery of bitumen from bitumen froth produced from tar sands to provide a bitumen end product substantially separated from water, solids, and asphaltenes, said process comprising:

(a) providing an aqueous bitumen froth concentrate comprised of bitumen, solids and asphaltenes;

(b) contacting said bitumen froth in a counter-current decantation washing system with a paraffinic hydrocarbon as a solvent for said bitumen without requiring the use of caustic soda and thereby produce a bitumen end product substantially separated from water, solids, and asphaltenes while producing a residuum comprising dilute bitumen, solvent, water, solids and asphaltenes;

(c) subjecting said residuum to gravity separation and thereby produce a dilute bitumen phase dissolved in said solvent, a water phase, asphaltenes and solids;

(d) recycling said dilute bitumen phase from said gravity-separated residuum into said counter-current decantation system while forming a second residuum comprised of water, asphaltenes and solids;

(e) subjecting said second residuum to filtration to produce a solids residue which is discarded and a water phase, and (f) recycling said water phase.

2. The process of claim 1, wherein said counter-current decantation washing system comprises a series of mixers and interconnected settlers including a first mixer and connected settler, a second mixer and connected settler and extending up to an Nth mixer and connected settler which comprises:

(a) feeding said froth to said first mixer to form a uniform mixture thereof; passing said mixture to a first settler from which an overflow of liquid is obtained comprised of dilute bitumen which is removed as a product while forming a first residuum in said first settler comprising bitumen, water and solids;

feeding said first residuum to a second mixer and providing a liquid overflow thereof which is fed to a second settler in which a second residuum is formed which is passed along to a succeeding mixer;

feeding an hydrocarbon solvent to said succeeding mixer and mixing said solvent with said second residuum to form a mixture thereof, feeding said mixture to a succeeding settler from which tailings are removed and the liquid remaining fed to said second mixer, and repeating said counter-current process with additional froth, whereby a bitumen is obtained as an end product by gravity separation.

3. The process as set forth in claim 2 wherein the dilute bitumen product is substantially free of water, solids, and asphaltenes and contains less than about 100 parts-per-million of solids is directly fed to a hydrocracker.

4. The process as set forth in claim 1 wherein the bitumen froth concentrate is produced using a hot water process together with gravity separation.

5. The process as set forth in claim 2 wherein the bitumen froth concentrate is produced using a hot water process together with gravity separation.

6. The process as set forth in claim 5 wherein the hot water process used to produce the bitumen froth concentrate has a temperature of about 35° to about 55° C.

7. The process as set forth in claim 5 wherein the bitumen froth concentrate produced by the hot water process comprises approximately 60% by weight bitumen, about 30% by weight water, and about 10% by weight solids and asphaltenes.

8. The process as set forth in claim 3 wherein the bitumen froth concentrate is produced using a hot water process.

9. The process as set forth in claim 8 wherein the hot water process used to produce the bitumen froth has a temperature ranging from about 35° and to about 55° C.

10. The process as set forth in claim 9 wherein the bitumen froth concentrate produced by the hot water process comprises approximately 60% by weight bitumen, 30% by weight water and 10% by weight solids and asphaltenes.

11. The process as set forth in claim 1 wherein the paraffinic solvent has a chain length of 5 to 8 carbons.

12. The process as set forth in claim 11, wherein the paraffinic solvent also contains an aromatic component.

13. The process as set forth in claim 11, wherein the paraffinic solvent comprises a mixture of pentane and hexane.

14. The process as set forth in claim 13, wherein the paraffinic solvent diluent comprises a mixture of about 50% by weight pentane and about 50% by weight hexane.

15. A process for the extraction and recovery of bitumen from bitumen froth produced from tar sands to provide a bitumen end product substantially separated from water, solids and asphaltenes which comprises:

subjecting an aqueous bitumen froth concentrate to a counter-current decantation washing system using a paraffinic hydrocarbon as a solvent without requiring the use of craustic soda and thereby produce a dilute bitumen end product and a residuum comprising bitumen froth tailings containing residual bitumen, solvent, water solids and precipitated asphaltenes, subjecting said residuum to a first gravity separation step and thus form a residual bitumen phase, a solvent phase, precipitated asphaltenes, water phase and a solids phase, recycling said residual bitumen phase to said counter-current decantation system, subjecting said solvent, precipitated asphaltenes and water phase produced by said first gravity separation step to a second gravity separation step to produce a solvent phase, precipitated asphaltenes phase and a water phase;

filtering the water and solids phase produced in said second gravity separation step and thereby produce filtered solids which are discarded as tailings and a water filtrate which is recycled for the treatment of sands;

recycling the solvent phase produced in said second gravity separation step to said first gravity separation step;

subjecting said solvent and said precipitated asphaltenes present in said second gravity separation step to distillation to produce a vapor of the solvent which is condensed and then recycled to said first gravity separation step while producing a residuum comprising said asphaltenes solids substantially free of solvent which are disposed of; and finally recycling the water phase produced in said second gravity separation step for the treatment for sands.

* * * * *